US006240739B1

(12) United States Patent
Hayes

(10) Patent No.: US 6,240,739 B1
(45) Date of Patent: Jun. 5, 2001

(54) DISPLAY REFRIGERATOR EVAPORATOR COVER

(75) Inventor: Paul Michael Hayes, Milwaukee, WI (US)

(73) Assignee: Zero Zone, Inc., North Prairie, WI (US)

( * ) Notice: Subject to any disclaimer, the term of this patent is extended or adjusted under 35 U.S.C. 154(b) by 0 days.

(21) Appl. No.: 09/640,414

(22) Filed: Aug. 17, 2000

(51) Int. Cl.[7] ..... A47F 3/04
(52) U.S. Cl. ..... 62/255; 62/256; 454/193
(58) Field of Search ..... 62/255, 246, 256; 312/116; 454/193

(56) References Cited

U.S. PATENT DOCUMENTS 4,431,905 * 2/1984 Slocum ..... 219/274
5,727,859 * 3/1998 Jeong et al. ..... 312/404

* cited by examiner

*Primary Examiner*—William E. Tapolcai
*Assistant Examiner*—Mohammad M Ali
(74) *Attorney, Agent, or Firm*—Michael Best & Friedrich, LLP

(57) ABSTRACT

A cover for a cooling unit, such as an evaporator assembly, of a display refrigerator. The cover is advantageously made of a single piece of material, preferably an injection molded, filled polypropylene plastic, which is capable of withstanding the harsh conditions found in a display refrigerator. The cover is further advantageously configured to enhance the operation of the evaporator assembly, protect the evaporator assembly, insulate the frozen or refrigerated food and drink items from the heat generated by the evaporator assembly, and decrease the time needed to install the cover into or remove the cover from the display refrigerator.

20 Claims, 4 Drawing Sheets

66
98
86
110
118
90
102
106
172
126
142
106
154
86
106
130
130
94

DISPLAY REFRIGERATOR EVAPORATOR COVER

BACKGROUND OF THE INVENTION

1. Technical Field

The invention relates to display refrigerators, and more particularly to display refrigerators having an internal evaporator assembly.

2. Related Prior Art

Display refrigerators are commonly used in retail outlets such as supermarkets, restaurants, convenience stores and other establishments that sell frozen or refrigerated items. Display refrigerators typically include a case having a plurality of shelves supporting the items on display. Doors, usually made of glass, allow a consumer to survey the selection of items without having to open one or more of the doors. When a selection is made, the consumer opens the appropriate door, removes the desired item and thereafter closes the door.

It is known to provide a display refrigerator with an evaporator assembly to keep the interior display space of the refrigerator cold. The evaporator assembly is generally housed beneath the interior display space. It is also known to provide the display refrigerator with a fan that is operable to circulate air contained by the display case through the evaporator assembly. In general, the fan draws air from the interior display space through the evaporator assembly where the air is cooled, and then recirculates the air into the interior display space. In this regard, display refrigerators periodically operate to defrost the refrigerant coils that are part of the evaporator assembly. A consequence of such defrost cycles is that periodically the evaporator warms the air in the lower region of the display case adjacent the evaporator coils.

It is also generally known to separate the evaporator assembly with a grill or cover to conceal the evaporator assembly and to protect the components of the evaporator assembly from damage by items falling from the shelving or by spillage. Known covers are often made of multiple pieces which are configured to cooperate in forming an evaporator cover assembly and which extend between the front of the display case and the back of the display case. The individual pieces of the cover assembly are generally made of metal grills and/or sheets to provide strength and to withstand low temperatures, though it is also known to provide a multiple piece cover assembly made of plastic or a combination of metal and plastic. The individual pieces are also configured to expand and contract when exposed to varying temperature conditions in the display refrigerator caused by the alternating operation of the evaporator assembly through cooling and defrost cycles.

SUMMARY OF THE INVENTION

As can be appreciated, a cover used to conceal an evaporator assembly placed beneath an interior display space must be of sufficient strength to substantially span the distance between the front of a display case to the back of a display case or to the front of the evaporator coil. The cover must also be able to withstand the low operating temperatures of a display refrigerator without cracking. Moreover, during defrost cycles the air in the interior display space above the cover is generally colder than the air directly surrounding the evaporator assembly and below the cover. Thus, the cover must also be able to withstand a temperature differential between its top side and its bottom side without cracking.

A problem with metal grills and covers is that manufacturing costs for metal display refrigerator evaporator covers are not viewed as cost effective. Furthermore, metal is generally a poor insulator. As a consequence, the warmth generated by the evaporator assembly or other heat source during defrost cycles is permitted by metal covers to infiltrate the upper regions of the display refrigerator. This heat infiltration is undesirable primarily because of the prospective damage to goods in the display refrigerator. Another substantial disadvantage caused by heat transfer through known cover assemblies is the fact that the defrost cycles must continue for a longer period than optimum, and subsequent cooling cycles must cool not only air warmed in the lower regions of the display refrigerator, but also the air in the upper display. Another problem with grills in general is that particulates, such as dust, dirt and the like, can fall through the grill into the evaporator assembly and, consequently, adversely affect the operation of the evaporator assembly. In addition, grills often expose pipes, wiring, conduits and other utilities serving the evaporator assembly, as well as dirt, dust and other articles that may fall into the lower portion of the display refrigerator. Such exposure is generally unsightly and undesirable in a retail setting.

Known plastic evaporator assembly covers present deficiencies in the areas of strength and durability. In general, known plastic cover assemblies are not sufficiently strong to span the distances necessary to cover an evaporator assembly. Also, known plastic covers tend to crack at low temperature.

One problem with known multiple piece cover assemblies concerns the amount of time needed to install the pieces into or remove the pieces from a display refrigerator. Multiple piece evaporator assembly covers made of a metal portion and a plastic portion have stress concentrations at the interface of the two different materials because, e.g., of the differences in the expansion and contraction properties of the different materials. These stress concentrations often result in cracking, and generally adversely affect the overall function of the covers and reduce the accepted operating life of the covers.

The invention addresses the problems presented by the prior art. In one aspect, the invention provides a cover that can be positioned between a cooling unit of a display refrigerator and an interior display space of the display refrigerator. The cover is advantageously made of a single piece of material which is adapted to expand from the front of the display case to at least the front of the evaporator coil. Preferably, the single piece cover is made of an injection molded plastic material. The single piece cover is sufficiently strong to span the distance between the front and the back of the display case without sagging or bending. The single piece cover can be exposed to varying temperatures, including very low temperatures, without being damaged or cracked. The single piece cover can also withstand temperature gradients on opposite sides of the cover. Additionally, the single piece cover is a better insulator than metal covers, thereby protecting the items stored in the interior space of the display case from the heat generated by the evaporator assembly during defrost cycles.

In one embodiment, the invention provides a cover positioned between an evaporator assembly and an interior display space of a display refrigerator. The cover includes a main body portion and a grill portion that affords fluid flow, such as air flow, communication between the evaporator assembly and the interior display space, and wherein the main body portion and the grill portion are formed as a single piece of material.

In another embodiment, the invention provides a cover adapted to be housed in a display refrigerator having a display case and an evaporator assembly within the display case. The cover includes an imperforate main body portion overlying the evaporator assembly and a grill portion affording fluid flow communication between the evaporator assembly and the remainder of the display case, wherein the main body portion and the grill portion are formed as a single piece of injection molded plastic material.

In another embodiment, the invention provides a display refrigerator including a display case having a front wall and a rear wall defining an interior space, and an evaporator assembly housed within the interior space. The refrigerator also includes a cover positioned adjacent the evaporator assembly and separating the interior space into a display space and an evaporator assembly portion, the cover extending between the front wall and the rear wall. The cover includes an imperforate main body portion and a grill portion affording fluid flow communication between the display space and the evaporator assembly portion. The grill portion includes a first set of spaced apart, substantially vertical parallel walls and a second set of spaced apart, substantially non-vertical parallel walls which interconnect with said first set of walls to form a plurality of openings. The main body portion and the grill like portion are formed as a single piece of filled polypropylene injection molded plastic. The cover also includes a first side defining a first tab having a recessed upper surface and the cover also includes a second side defining a second tab having a recessed underside and being adapted to be engaged by the first side of a second cover to define therebetween a lap joint.

In another embodiment, the cover further includes a locating stud that is positioned to properly locate the cover within the display refrigerator.

The invention also provides a display refrigerator having a longitudinal length and a cover assembly including multiple covers configured such that portions of adjacent covers are configured to form a lap joint. The covers expand from one side of the display refrigerator to the other. The lap joints provide a simple, yet effective, manner of installing and removing individual covers into and out of a display refrigerator.

In yet another preferred embodiment, the cover includes a notch or recess providing clearance for structural members of the display refrigerator that may support, for example, the display case and/or shelving or to provide clearance for electrical wiring, such as for a lighting system, of the display refrigerator.

Thus the invention provides a unique and advantageous display refrigerator evaporator cover.

The invention also provides a new and improved display refrigerator evaporator cover which is simple to use and relatively inexpensive to make.

The invention provides a display refrigerator cover which conceals the evaporator assembly and other pipes and utilities connected to the evaporator assembly. The cover also prevents dust, dirt and other particulates from passing from the upper regions of the display into the lower portion of the display cabinet housing the evaporator assembly.

Another feature of the invention is a display refrigerator evaporator cover that reduces the overall time needed to install or remove the cover, and that serves as a product stop preventing items from falling into the evaporator assembly.

Still another feature of the invention is a display refrigerator evaporator cover having sufficient strength and made of appropriate material to withstand the environmental conditions of display refrigerators.

Other features and advantages of the invention will become apparent to those skilled in the art upon review of the following detailed description, claims and drawings in which like numerals are used to designate like features.

Figure 1:
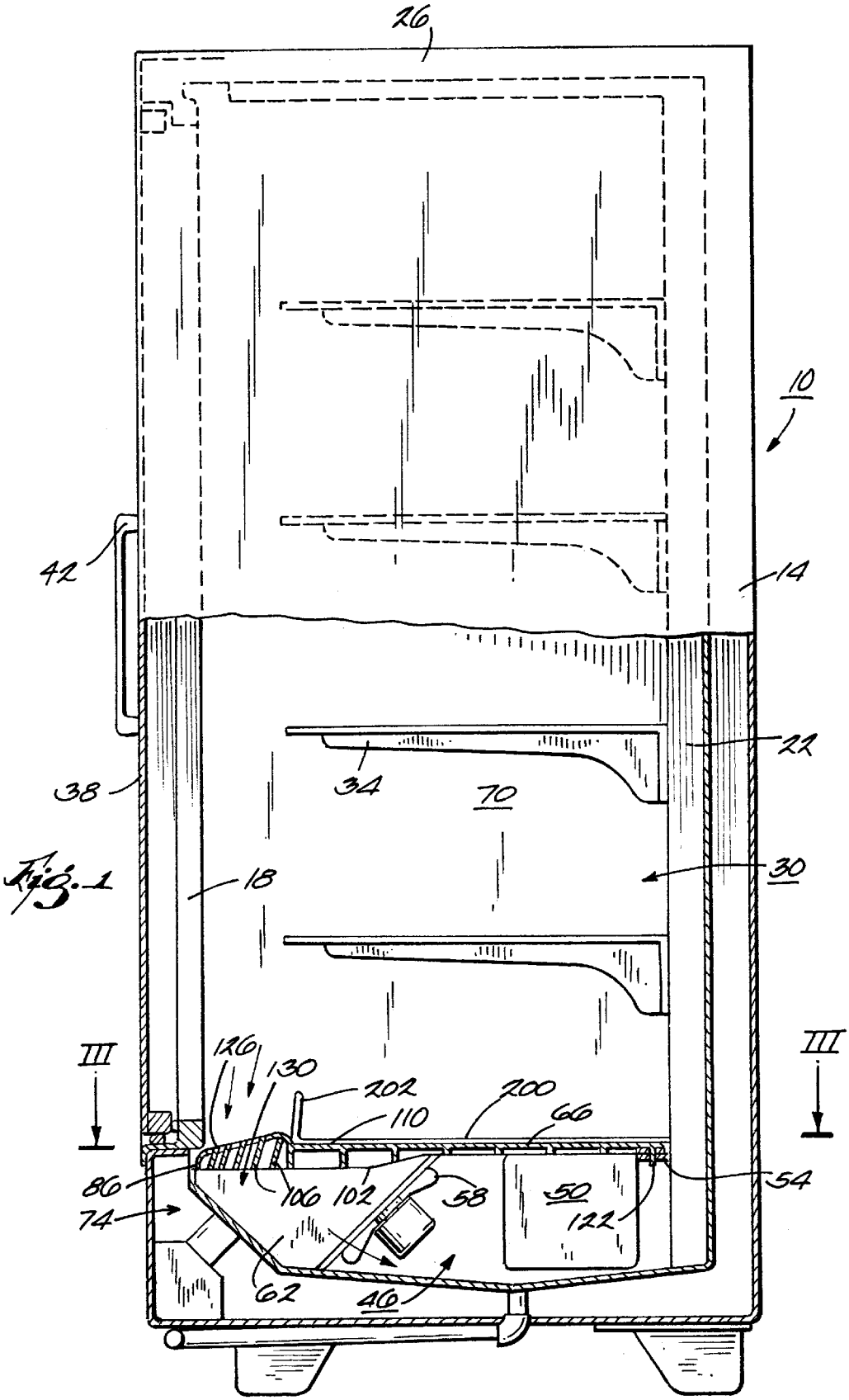
FIG. 1 is a side view, partially in section, of a display refrigerator embodying the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting.

DETAILED DESCRIPTION OF THE PREFERRED EMBODIMENT

FIG. 1 illustrates a display refrigerator 10 embodying the present invention. The display refrigerator 10 includes a display case 14 having a front wall 18, a rear wall 22 and top wall 26 defining there between an interior space 30. The display refrigerator 10 also includes a plurality of shelves 34 mounted on the rear wall 22 and extending into the interior 30 of the display case 14 for displaying food or drink items. The display refrigerator also includes one or more glass doors 38 which are mounted on the front wall 18 and which allow a consumer to survey the interior 30 of the display case 14 before opening the door 38 by way of handle 42.

The display refrigerator 10 also includes an evaporator assembly 46 which is housed in the lower portion of the display case 14 and which is operable to keep the interior 30 of the display case 14 cold. The evaporator assembly 46 includes cooling coils 50 (shown schematically in FIG. 1 as a bundle of coils and fins) which extend along the length of the display case 14. For reasons discussed below, the evaporator assembly also includes (FIGS. 1 and 4) a cover mount 54 extending along the lower rear wall 22 into the interior 30 of the display case 14 and having therein one or more location slots or apertures 56.

The evaporator assembly 46 also includes a fan 58 which is mounted on a plenum 62 located adjacent the lower front wall 18 of the display case 14. During cooling cycles (as represented by arrows in FIG. 1), the fan 58 draws air in the interior 30 of the case through the fan plenum 62 and drives the air rearward past the evaporator coils and fins 50 where the air is cooled or, alternatively, heat is removed. In order to defrost the cooling coils and fins 50 of the evaporator assembly 46, the flow of refrigerant through the evaporator coils is periodically reversed. As is further generally understood, the operation of the evaporator assembly 46 during defrosting cycles generates heat in the region of the coils and fins 50 either through reverse operation of the evaporator assembly or by other means (not shown), such as by electric or hot gas defrost systems.

The display refrigerator 10 also includes an evaporator cover 66. The cover 66 extends between the front wall 18 and the rear wall 22 of the display case 14, and overlies the evaporator assembly 46. The cover 66 conceals the evaporator assembly 46 and protects the components of the evaporator assembly 46 from damage such as if, for example, an item falls from a shelf 34. The cover 66 also separates the interior space 30 of the display case 14 into an upper, display portion 70 and a lower, housing portion 74.

Figures 2, 4, 5:
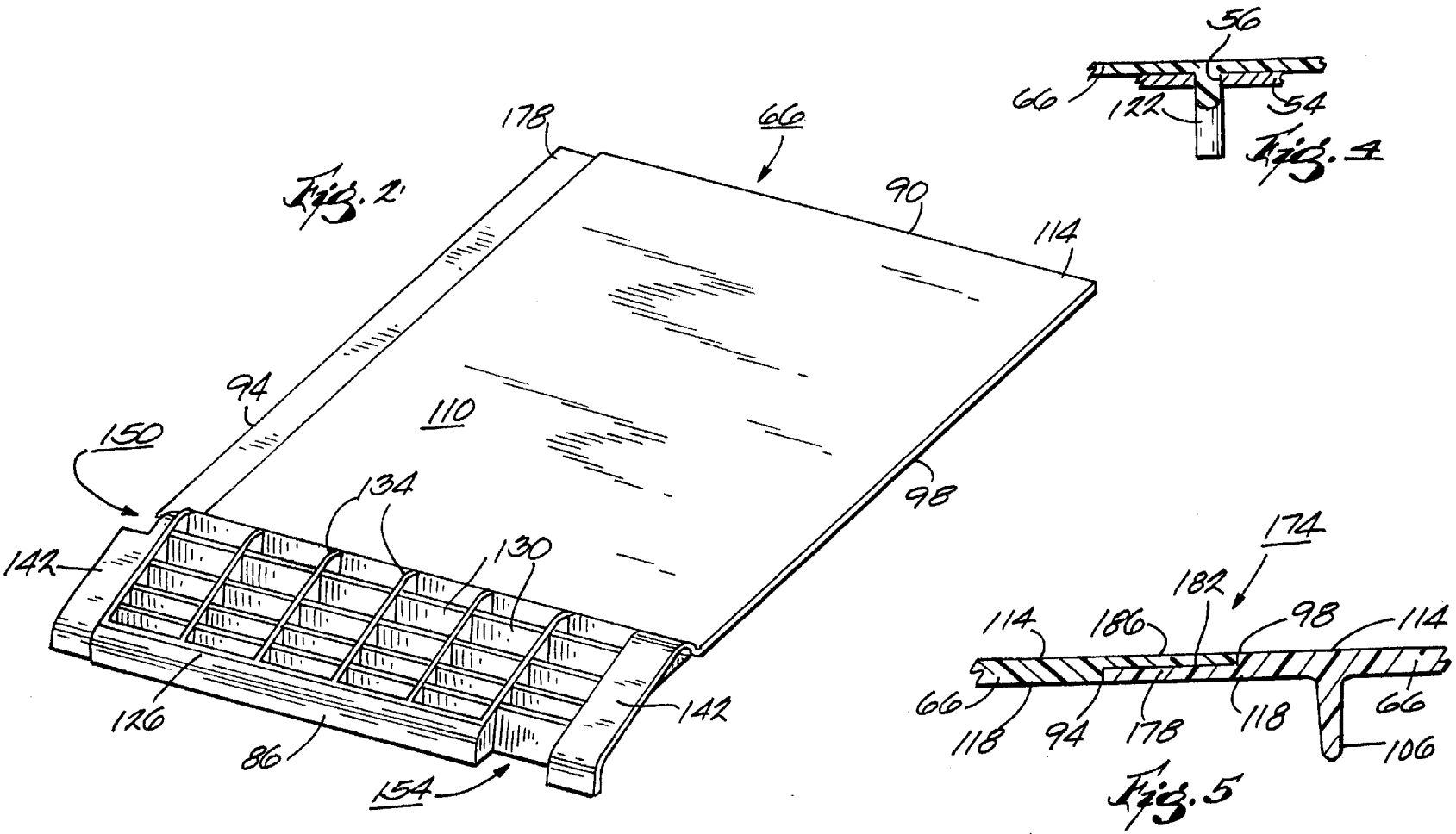
FIG. 2 is a perspective view of the display refrigerator evaporator cover shown in FIG. 1.
FIG. 4 is a partial cross-sectional view taken along line IV—IV in FIG. 3.
FIG. 5 is a partial cross-sectional view taken along line V—V in FIG. 3.

Referring to FIG. 2, the cover 66 is made of a single piece of plastic and preferably is made by injection-molded or thermo-forming. Although various compositions or types of plastic will work according to the principles of the present invention, a filled polypropylene sold by Ferro Corporation under product code LPP40YR01 is particularly well suited for use in fabricating the cover 66 by injection molding. This, and other suitable plastics, has an R factor superior to that of metal and, therefore, has superior insulative properties compared to metal. Thus, the cover 66 also functions as an insulator between the display space 70 where the cold items are stored and the housing portion 74 wherein the evaporator assembly 46 periodically generates heat, thereby protecting the items housed in the display case 14 from being adversely heated.

Figure 6:
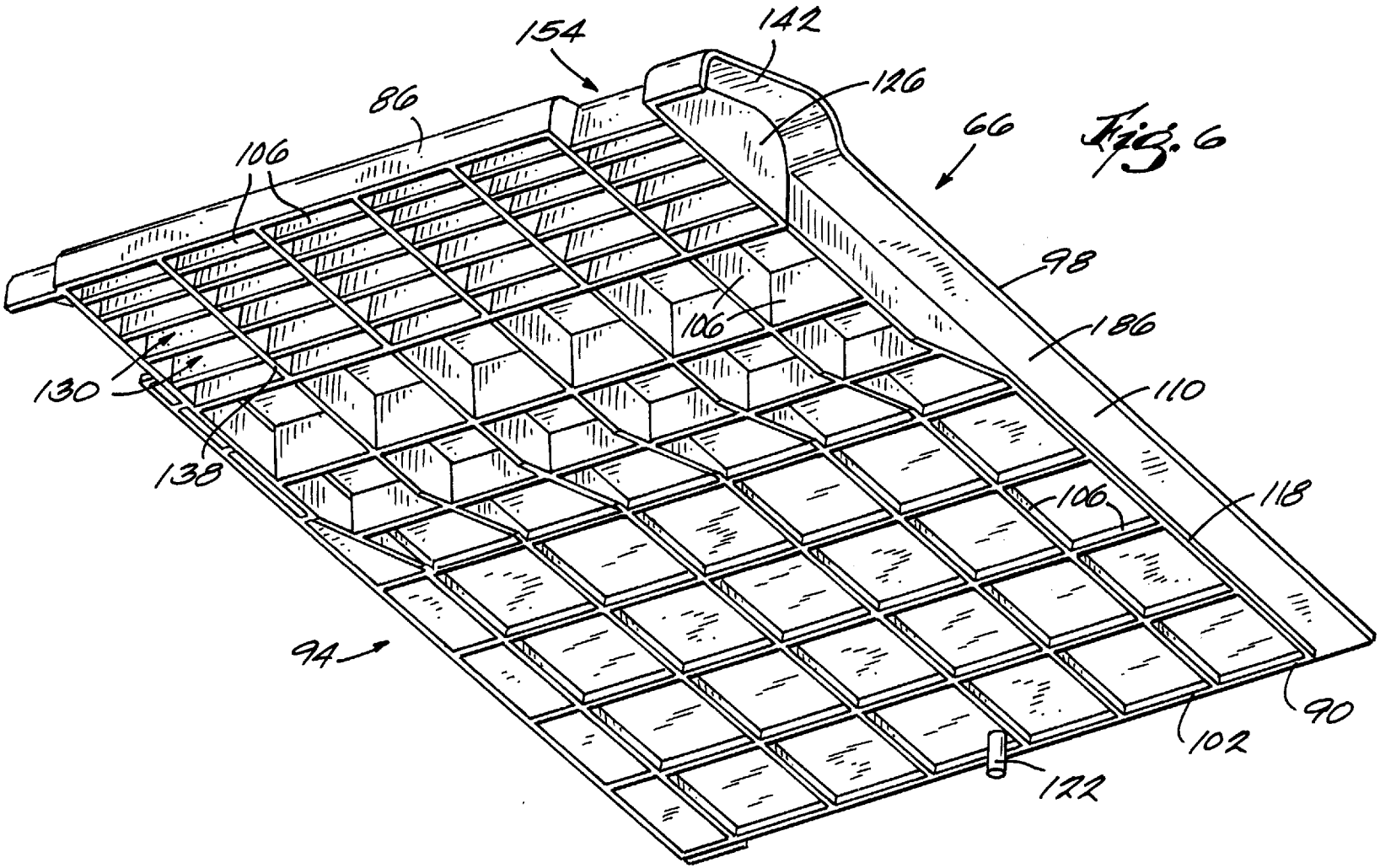
FIG. 6 is a perspective view similar to FIG. 2 and shows the underside of the display refrigerator evaporator cover shown in FIG. 2.

The cover 66 is generally rectangular but may be of different shapes depending on the configuration of the display refrigerator 10. The cover 66 includes (FIG. 2) a front edge 86, a rear edge 90, and opposite sides 94 and 98. As best shown in FIG. 1, when installed in the display case 14, the front edge 86 of the cover 66 is adjacent the front wall 18 of the display case 14 and overlies the fan plenum 62, and the rear edge 90 of the cover 66 is adjacent the rear wall 22 of the display case 14 and overlies the cover mount 54. As best shown in FIGS. 1 and 6, the underside of the cover 66 has a grid or lattice 102 of spaced-apart, generally straight and parallel elongated structural walls or ribs 106 extending between the opposite sides 94 and 98 of the cover 66 and between the front and rear edges 86 and 90 of the cover 66. The structural ribs 106 vary in height depending on the location of the ribs 106 between the sides 94, 98 and edges 86, 90 to accommodate the configurations of the fan plenum 62, the evaporator assembly 50 and cover mount 54, while at the same time providing a generally horizontal upper surface. The ribs 102 provide structural strength and stability to the cover 66 to prevent warping and cracking in the cover 66 under loading and thermal stress.

More particularly, the cover 66 (FIG. 2) includes a main body portion 110 which is bounded by the rear edge 90 and the opposite sides 94, 98 and which extends toward the front edge 86. The main body portion 110 is imperforate and serves an air flow management function by preventing air flow between the display portion 70 of the case 14 and the evaporator housing 74. The main body portion 110 of the cover 66 provides a planar upper surface 114 and (FIG. 6) an underside 118 including the grid 102 of ribs 106. In the illustrated embodiment, near the rear edge 90 of the cover 66, the ribs 102 are relatively shallow, and over the fan plenum 62, the ribs 106 are deeper.

The main body portion 110 also includes (FIGS. 4 and 6) a locating member or stud 122 extending from the underside 118 of the cover 66 adjacent the rear edge 90. The locating member 122 is received by the aperture 56 in the cover mount 54 so that the cover 66 can be properly and easily located within the display case 14 (see also FIG. 1). It should be noted that the locating stud 122 could be alternatively positioned elsewhere on the cover 66 so as to mate with an appropriately positioned aperture or the like in the display case 14. Alternatively, the cover 66 could include an aperture or the like similar to aperture 56, and the display case 14 could include a locating member similar to locating member 122.

The cover 66 also includes a grill portion 126 adjacent the main body portion 110 and the front edge 86 of the cover 66. The grill portion 126 also performs air flow management functions by permitting flow of air therethrough. To that end, the grill portion 126 is generally defined by the structural ribs 106 extending from the main body portion 110 toward the front edge 86 and by ribs 106 which extend substantially parallel to the front edge 86 between the sides 94, 98. In the grill portion 126 of the cover 66, the grid 102 of ribs 106 defines a plurality of openings 130 communicating between the top and bottom surfaces 134, 138 (FIG. 6) of the cover 66, which are respectively defined by the upper and lower extents of the ribs 106. The top surface 134 of the grill portion 126 adjacent the main body portion 110 extends upwardly from the top surface 114 and has a profile (FIG. 1) which curves toward the front wall 18 such that the rearward portion of the grill portion 126 is vertically offset from the forward portion of the main body portion 110. The grill portion 126 also includes a pair of imperforate sections 142 extending toward the front edge 86 of the cover 66 and respectively along the opposite sides 94, 98 of the cover 66.

The top surface 134 of the grill portion 126 ramps downwardly from the rearward extent of the grill toward the front edge 86. This vertical displacement and ramping of the grill portion 126 discourages the placement of items onto the grill portion 126, which could adversely affect the overall operation of the evaporator assembly 46 by blocking air flow. In this regard and as best shown in FIG. 1, the ribs 106 in the grill portion 126 which extend laterally between the sides 94, 98 of the cover 66 lie in a plane which is at an acute angle relative to vertical. The laterally extending ribs 106 are so positioned to enhance the proper flow of air from the interior display space 70 through the cover 66 and into the evaporator assembly housing 74. Also, the angled orientation of the ribs 106 tends to conceal the evaporator assembly 46 from direct observation from outside the front of the display case 14 and prevents the passage of dust, dirt and other particulates into the housing portion 74 for the evaporator assembly 46. In addition, the angled orientation of the ribs 106 prevents the observation of dust, dirt and other articles that may have fallen into the lower portion of the display refrigerator 10.

Thus, the cover 66 includes a main body portion 110 and a grill 126 which affords fluid flow communication between the evaporator assembly housing 74 and the interior display space 70, and provides a cover 66 wherein the main body portion 110 and the grill portion 126 are formed as a single piece of material.

With reference to FIG. 2, the cover 66 preferably includes a notch or recess 150 in one of the sides 94, 98 in order to provide clearance for vertically extending structural members (not shown) that may be provided in the display case 14 and/or shelving 34. Although not shown, the cover 66 may also include one or more notches like notch 150 elsewhere in the cover 66 depending on the design of the display case 14. The cover 66 also preferably includes a notch or recess 154 in the front edge so as to provide clearance for an insulated wire bundle or the like (not shown) provided in the display refrigerator 10 for lighting devices or other electrical devices (not shown) which may be mounted in or on the display case 14. Preferably, the notch 154 is defined by a gap in the front edge 86 and by rib segments 106. Alternatively, one or more notches like notch 154 could be positioned elsewhere in the cover 66, depending on the design of the display case 14. If utilized, the notches 150 and 154 are preferably molded into the single piece cover 66 by installing inserts (not shown) in the injection molding tooling which correspond to the shape and size of the notches. Thus, the cover 66 provides a single piece that extends between the front and rear walls 18, 22 of the display case 14.

Figure 3:
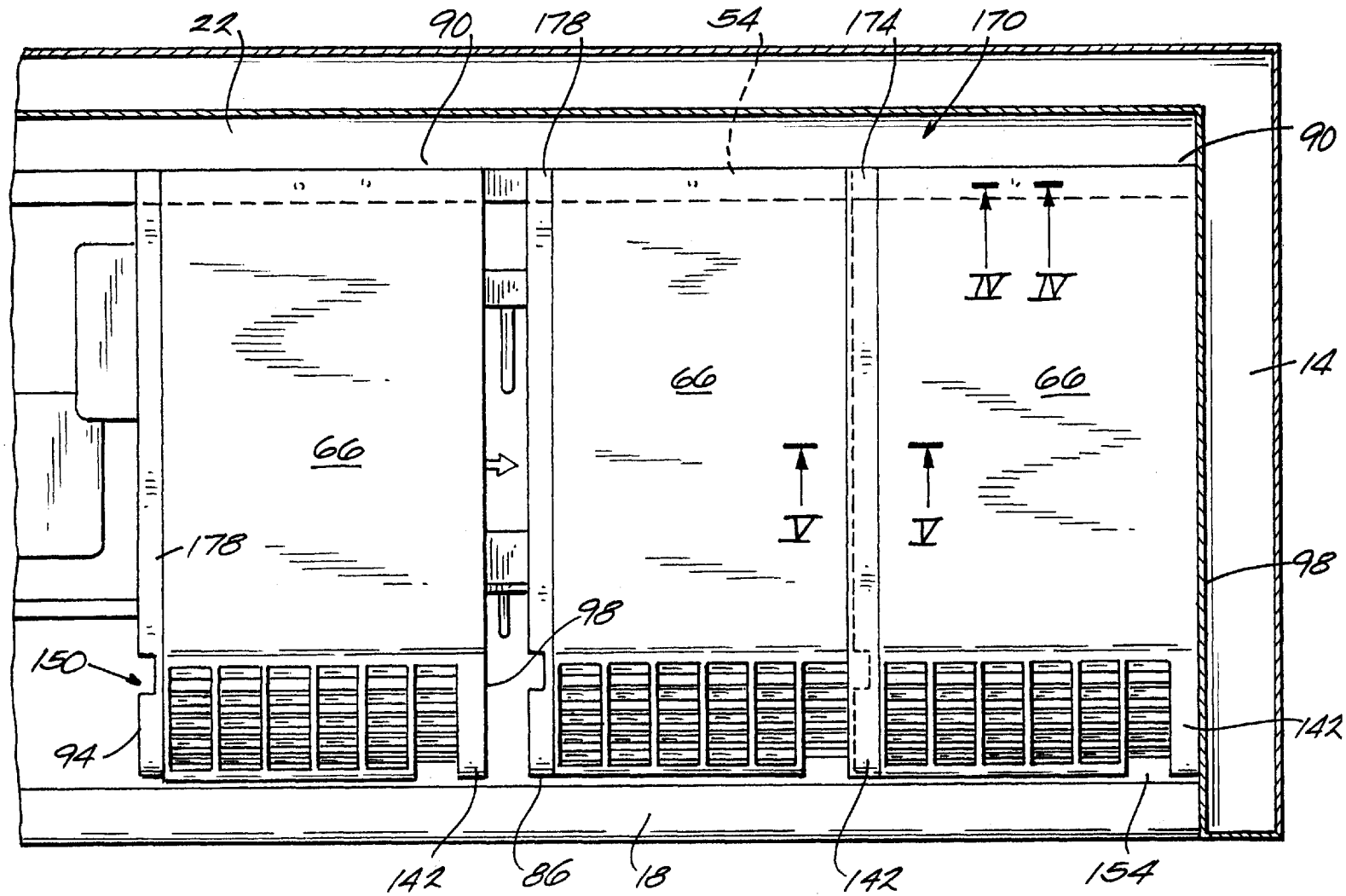
FIG. 3 is view taken along line III—III in FIG. 1.

Those of ordinary skill in the art will readily recognize that a display refrigerator 10 may have a length such that a single cover 66 can be used to separate the display 70 and evaporator housing 74 along the entire length of the display case 14. However, in the event the display case 14 is elongated, such as is shown in FIG. 3, then the invention also provides a cover assembly 170 comprising multiple covers 66, which extend from one side of the display case 14 to the opposite side. As shown in FIG. 3, the sides 94, 98 of each cover 66 are configured so as to cooperate and form a lap joint 174 with adjoining covers 66. As best shown in FIGS. 2 and 5, the opposite sides 94, 98 of the cover 66 have respective configurations that mate when overlapped. More particularly, one side 94 of the cover 66 includes a tab portion 178 that extends from the underside 118 of the cover 66 and that defines a recess 182 from the upper surface 114. Conversely, the opposite side 98 of the cover 66 includes a tab 186 which extends from the top surface 114 and which is configured to overlap the tab 178 and occupy the recess 182 so that the top surfaces 114 of the adjoining covers 66 are flush. The edges 94, 98 are thus configured and adapted to mate to form the lap joint 174 when assembled.

FIG. 1 also illustrates that the display refrigerator 10 can be provided with a bottom shelf 200 supported by the rear wall 22 in a position overlying the cover 66 or cover assembly 170. The bottom shelf 200 is configured to extend over the main body portion 110 without covering any part of the grill portion 126. The shelf 200 includes a vertical edge 202 adjacent the interface of the main body portion 110 and the grill portion 126, and is intended to discourage items placed on the shelf 200 from sliding onto the grill 126.

Variations and modifications of the foregoing are within the scope of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A cover positioned between an evaporator assembly and an interior display space of a display refrigerator, said cover comprising:

a main body portion and a grill portion which affords fluid flow communication between the evaporator assembly and the interior display space and wherein said main body portion and said grill portion are formed as a single piece of material.

2. A cover according to claim 1, wherein the display refrigerator includes spaced apart front and rear walls and wherein said cover is adapted to extend between the front and rear walls.

3. A cover according to claim 1 and further including a locating member for mating connection with a component of the display case so as to properly locate said cover within the display case.

4. A cover according to claim 1, wherein one side of said cover is adapted to be overlapped by a portion of an adjoining cover such that a lap joint can be created between the adjoining covers, and wherein an opposite side of said cover is adapted to overlap a portion of yet another adjoining cover such that a lap joint can be created between these adjoining covers.

5. A cover according to claim 1, wherein at least one side of said cover includes a notch which extends completely through said cover.

6. A cover according to claim 1, wherein said grill portion includes a notch which extends completely through said cover.

7. A cover according to claim 1, wherein said grill portion includes a first set of spaced apart, substantially vertical parallel walls and a second set of spaced apart, substantially non-vertical parallel walls which interconnect with said first set of walls to form a substantially grid like portion.

8. A cover according to claim 1, wherein said cover includes a top surface which is imperforate along said main body portion and which provides openings in said grill portion.

9. A cover according to claim 8, wherein said top surface which at least partially defines said grill portion is downwardly ramped toward an end of said cover.

10. A cover adapted to be housed in a display refrigerator having a display case and an evaporator assembly within the display case, said cover comprising:

an imperforate main body portion overlying the evaporator assembly and a grill portion affording fluid flow communication between the evaporator assembly and the remainder of the display case, said main body portion and said grill portion being formed as a single piece of injection molded plastic material.

11. A cover according to claim 10, wherein the display case includes a front wall and wherein the grill portion is located adjacent the front wall.

12. A cover according to claim 10, wherein the display case has a rear wall and wherein the cover includes a locating member located adjacent the rear wall.

13. A cover according to claim 10, wherein one side of said cover is adapted to be overlapped by a portion of an adjoining cover such that a lap joint can be created between the adjoining covers, and wherein an opposite side of said cover is adapted to overlap a portion of yet another adjoining cover such that a lap joint can be created between these adjoining covers.

14. A cover according to claim 10, wherein at least one side of said cover includes a notch which extends completely through said cover.

15. A cover according to claim 10, wherein said grill portion includes a notch which extends completely through said cover.

16. A cover according to claim 10, wherein said grill portion includes a first set of spaced apart, substantially vertical parallel walls and a second set of spaced apart, substantially non-vertical parallel walls which interconnect with said first set of walls.

17. A cover according to claim 10, wherein said single piece cover is made of a filled polypropylene.

18. A cover according to claim 10, wherein said cover includes a top surface which at least partially defines said main body portion and a plurality of ribs underlying the top surface.

19. A cover according to claim 18, wherein said top side of the main body portion is generally horizontal.

20. A display refrigerator comprising:

a display case having a front wall, a rear wall and defining an interior space;

an evaporator assembly housed within said interior space; and a cover positioned adjacent said evaporator assembly and separating said interior space into a display space and an evaporator assembly portion, said cover extending between said front wall and said rear wall, said cover including an imperforate main body portion, a grill portion affording fluid flow communication between said display space and said evaporator assembly portion, said grill portion includes a first set of spaced apart, substantially vertical parallel walls and a second set of spaced apart, substantially nonvertical parallel walls which interconnect with said first set of walls to form a plurality of openings, wherein said main body portion and said grill like portion are formed as a single piece of filled polypropylene injection molded plastic, said cover including a first side defining a first tab having a recessed upper surface and said cover including a second side defining a second tab having a recessed underside and being adapted to be engaged by the first side of a second cover to define therebetween a lap joint.

* * * * *